US011554467B2

(12) United States Patent
Lin

(10) Patent No.: US 11,554,467 B2
(45) Date of Patent: Jan. 17, 2023

(54) DRIVING TOOL

(71) Applicant: Ying-Mo Lin, Nantou County (TW)

(72) Inventor: Ying-Mo Lin, Nantou County (TW)

( * ) Notice: Subject to any disclaimer, the term of this patent is extended or adjusted under 35 U.S.C. 154(b) by 175 days.

(21) Appl. No.: 17/030,718

(22) Filed: Sep. 24, 2020

(65) Prior Publication Data

US 2021/0146510 A1 May 20, 2021

(30) Foreign Application Priority Data

Nov. 19, 2019 (TW) ..... 108142015

(51) Int. Cl.
*B25B 15/00* (2006.01)
*B25B 23/00* (2006.01)

(52) U.S. Cl.
CPC ..... *B25B 15/008* (2013.01); *B25B 23/0035* (2013.01)

(58) Field of Classification Search
CPC ..... B25B 15/008; B25B 23/108; B25B 13/02; B25B 23/16; B25B 15/02; B25B 15/004; B25B 13/54
USPC ..... 81/436, 186, 460, 461
See application file for complete search history.

(56) References Cited

U.S. PATENT DOCUMENTS

| | | | | |
|---|---|---|---|---|
| 2,083,092 | A * | 6/1937 | Richer | F16B 23/003 81/460 |
| 3,872,904 | A * | 3/1975 | Barlow | B25B 15/005 81/460 |
| 5,873,290 | A * | 2/1999 | Chaconas | B25B 15/005 81/436 |
| 7,452,361 | B2 * | 11/2008 | Kreidler | B25B 15/007 606/305 |
| 8,302,255 | B2 * | 11/2012 | Lin | B25B 15/008 81/436 |
| 10,081,094 | B2 * | 9/2018 | Doroslovac | B25B 23/0035 |
| 10,569,391 | B2 * | 2/2020 | Johnson | A61C 1/00 |
| 11,040,435 | B2 * | 6/2021 | Liu | B25B 15/008 |
| 2015/0335368 | A1 * | 11/2015 | Auger | B25B 15/004 81/436 |
| 2022/0281085 | A1 * | 9/2022 | Kukucka | B25B 23/105 |

FOREIGN PATENT DOCUMENTS

TW M583354 U 9/2019

* cited by examiner

*Primary Examiner* — David B. Thomas
*Assistant Examiner* — Jason Khalil Hawkins
(74) *Attorney, Agent, or Firm* — Muncy, Geissler, Olds & Lowe, P.C.

(57) ABSTRACT

A driving tool is providing, including: a driving end including three ribs which are angularly arranged in intervals, each of the three ribs being formed as a part of a rectangle and including two right angles, every adjacent two of the three ribs defining a groove therebetween.

9 Claims, 7 Drawing Sheets

DRIVING TOOL

BACKGROUND OF THE INVENTION

Field of the Invention

The present invention relates to a driving tool.

Description of the Prior Art

A conventional polygonal driving tool, such as hexagonal wrenches in TWM583354 and U.S. Pat. No. 8,302,255, has grooves formed on part or all of the engaging side faces of an engagement hole, to prevent slipping engagement of the wrench relative to the fastener and to avoid damage to the corners of the engagement hole of the fastener. That can result in failure of tightening or disassembly the fastener.

However, the groove of the conventional polygonal driving tool make the engaging side faces of the engagement hole have obtuse angles or/and acute angles so that the torsion force cannot be sufficiently transmitted to the fastener and so that it can causes weak structures near the edges of the grooves, and thus the structure of the driving tool is weak and is easy to be damaged.

The present invention is, therefore, arisen to obviate or at least mitigate the above-mentioned disadvantages.

SUMMARY OF THE INVENTION

The main object of the present invention is to provide a driving tool which is good in structural strength and torque transmission, and is uneasy to cause slipping disengagement relative to the object to be rotated.

To achieve the above and other objects, a driving tool is provided, including: a driving end including three ribs which are angularly arranged in intervals, each of the three ribs being formed as a part of a rectangle and including two right angles, every adjacent two of the three ribs defining a groove therebetween.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
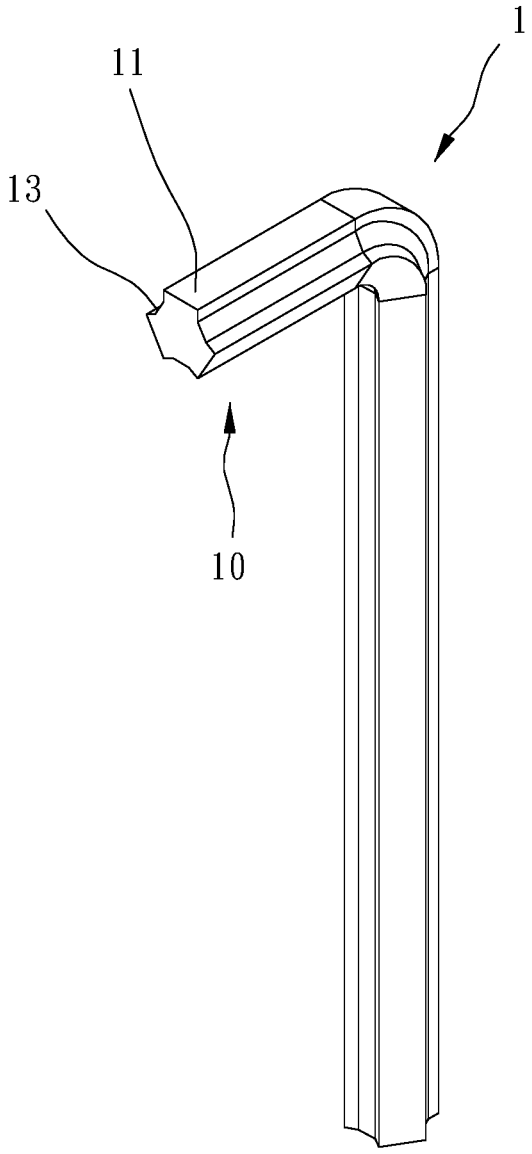
FIG. 1 is a stereogram of a preferable embodiment of the present invention.
Figure 2:
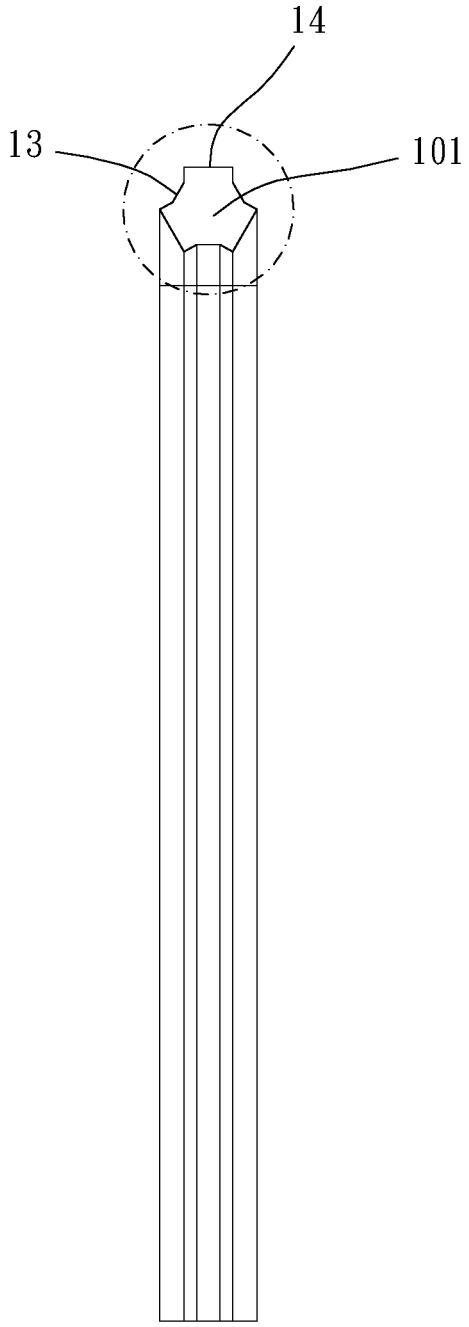
FIG. 2 is a side view of a preferable embodiment of the present invention.
Figure 3:
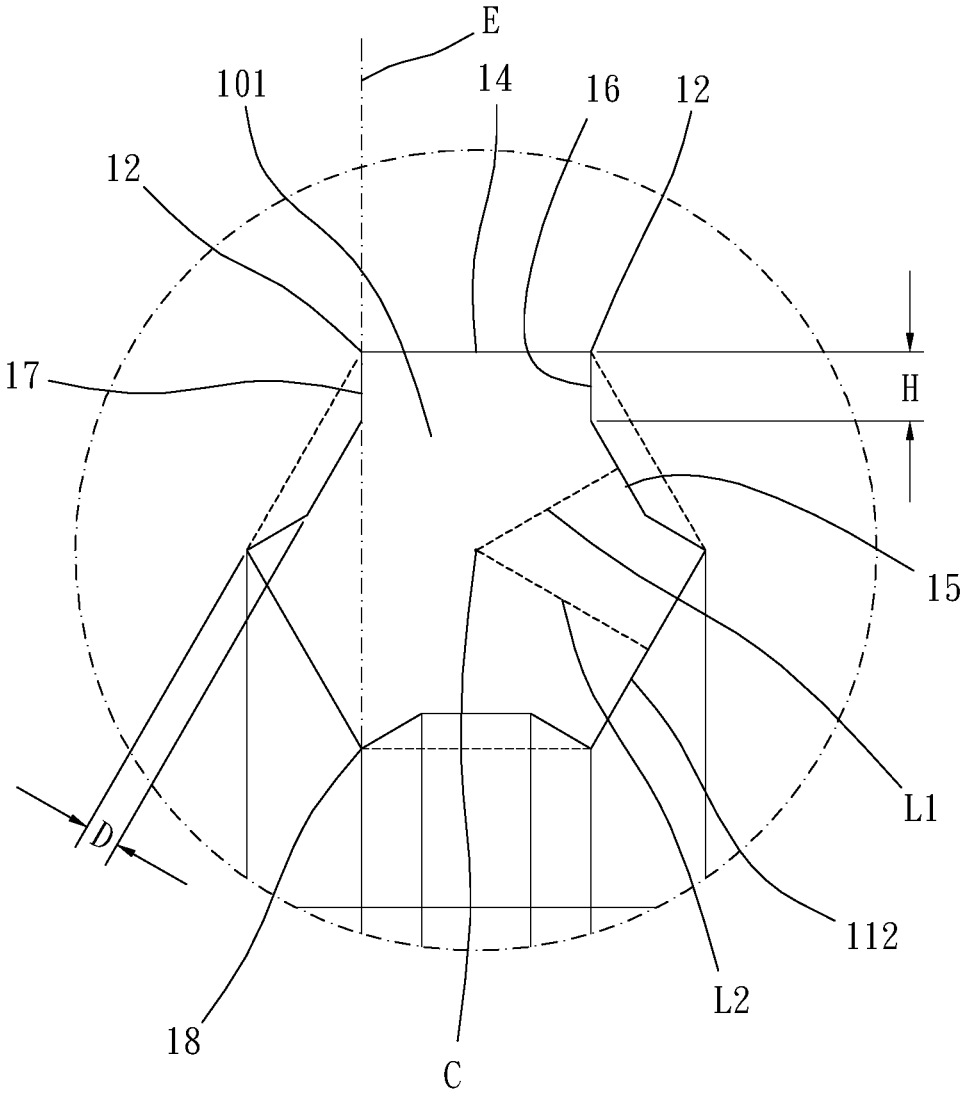
FIG. 3 is a partial enlargement of FIG. 2.
Figure 4:
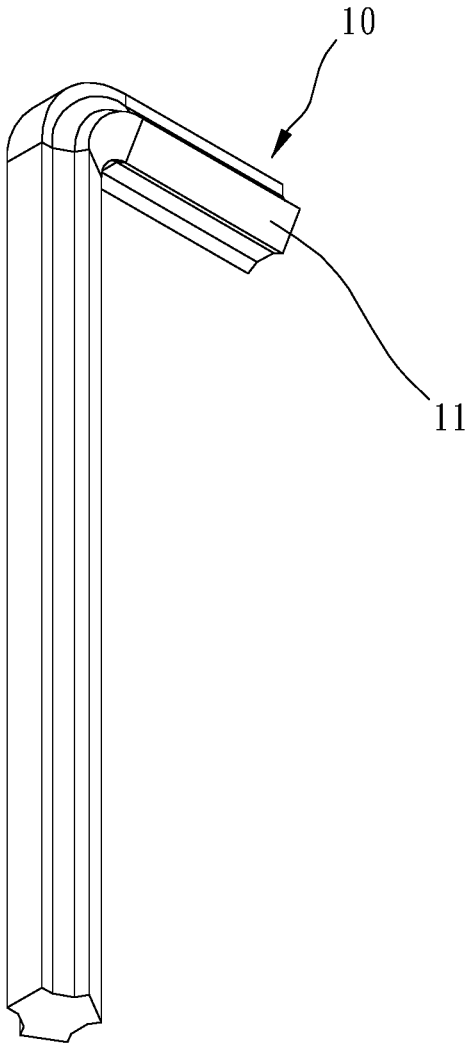
FIG. 4 is another stereogram of a preferable embodiment of the present invention.
Figure 5:
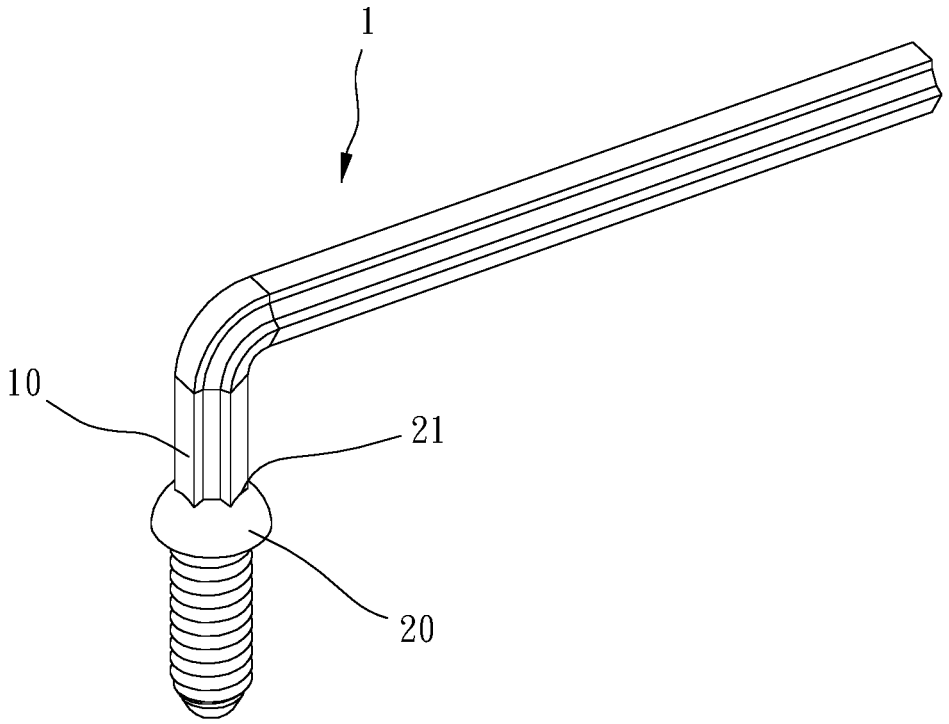
FIG. 5 is a drawing showing application of a preferable embodiment of the present invention.

Please refer to FIGS. 1 to 5 for a preferable embodiment of the present invention. A driving tool 1 of the present invention includes a driving end 10, the driving end 10 includes an end face 101 and three ribs 11 which are angularly arranged in intervals, each of the three ribs 11 is formed as a part of a rectangle on the end face 101 and including includes two right angles 12 on the end face 101, and every adjacent two of the three ribs 11 define a groove 13 therebetween. Whereby, the driving tool 1 is good in structural strength and torque transmission, and is uneasy to cause slipping disengagement relative to the object to be rotated. The driving end 10 may be inserted into a recess 21 of a driven member 20 (such as fastener) for driving the driven member 20 (FIG. 5), wherein the recess 21 and the driving end 10 mate with each other in shape. However, the driving end 10 may be inserted into a hexagonal recess.

Preferably, the three ribs 11 are equiangularly arranged in intervals, thus distributing stress evenly; every adjacent two of the three ribs 11 are connected with a plane 15 therebetween, and each said plane 15 is parallel to a radially-facing face 14 of one of the three ribs. Preferably, each said radially-facing face 14 has the same width, the plane 15 has a width equal to or greater than ½ of a width of the radially-facing face 14, and each said groove 13 expands radially outward so that it can provide large abutment area and even distribution of force. However, the bottom of the groove may be concave (arced face or transitional face) or convex (arced face or transitional face). Each of the three ribs 11 further includes a side face 16 whose height H is equal to a depth D of the groove 13 multiplied by [1/sin)(30°)], and each said groove 13 has the depth D of 0.20 mm to 1.50 mm, thus being good in driving object and structural strength. The end face 101 has a center C. A first distance L1 from a bottom of each said groove 13 to the center C is 0.20 mm to 1.50 mm smaller than a second distance L2 from a radially-facing face 14 of each of the three ribs 11 to the center C. Preferably, the height H of the side face 16 is between ⅕ to ⅓ of the second distance L2, which can provide good driving engagement and good structural strength. An extension E of a side 17 of each said right angle 12 extends through an apex 18 another said right angle 12, which provides good structural strength and efficient transmission of torque. Specifically, all of apexes 18 of the right angles 12 of the three ribs 11 are six apexes of a hexagon, and each of the three ribs 11 further includes a side 112 entirely overlapping with a side of the hexagon from one said apex 18 to another said apex 18.

Figure 6:
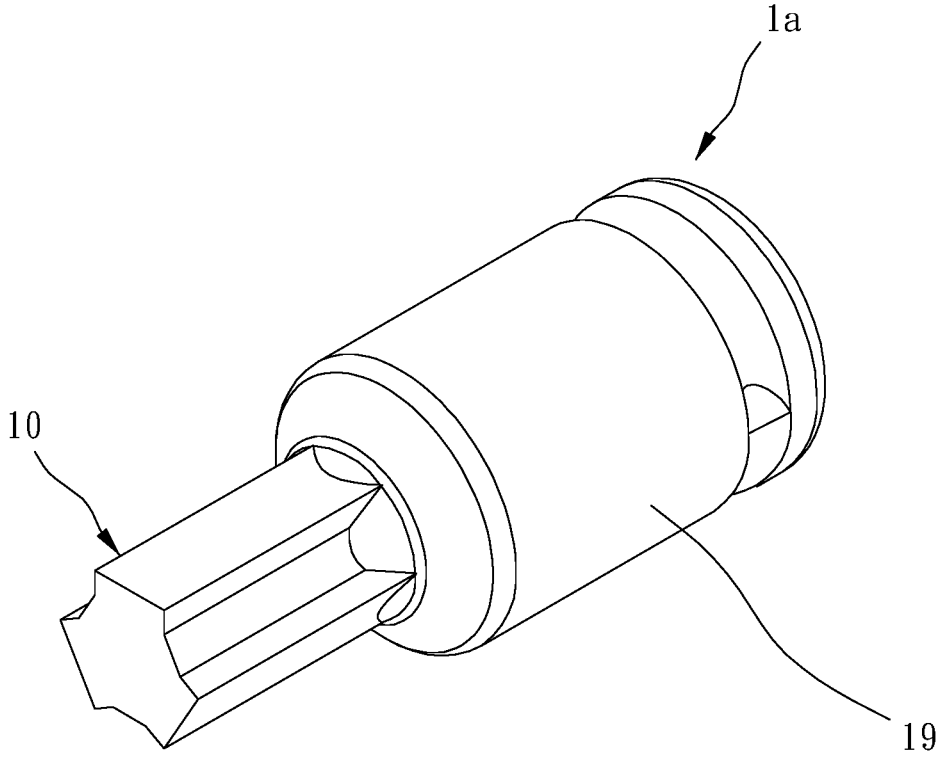
FIGS. 6 and 7 are stereograms of another preferable embodiment of the present invention.
Figure 7:
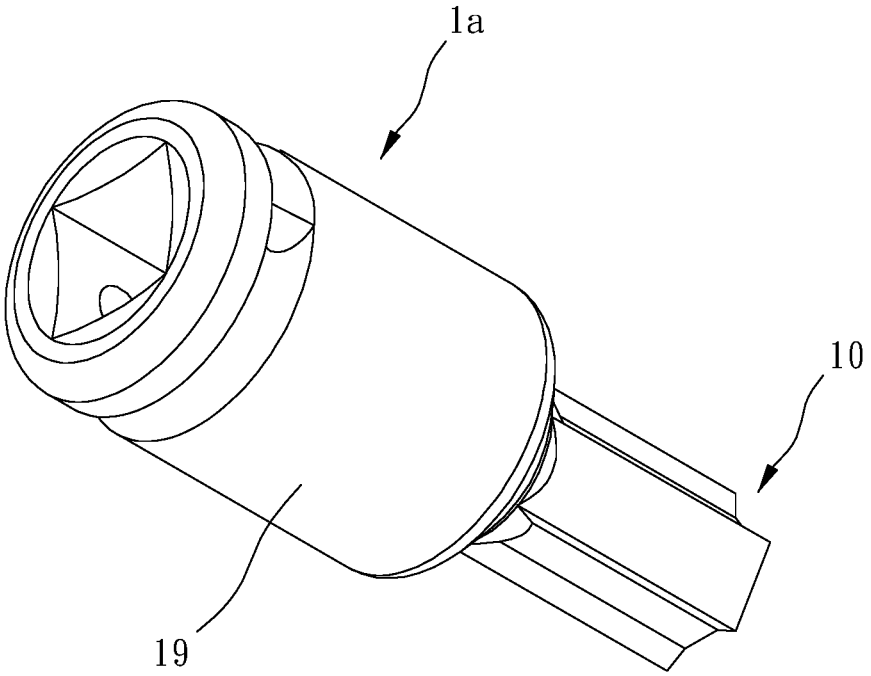

In this embodiment, the driving tool 1 is a rod member which is L-shaped and has a fixed cross-section. Each of the three ribs 11, each said groove 13 and the rod member have the same extending length. However, as shown in FIGS. 6 and 7, the driving tool 1*a* may further includes a socket 19 configured to be sleeved with a second driving tool (manual, pneumatic, electric or the like), and thus it can choose one of driving tool having a suitable driving end 10 according various requirements.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A driving tool, including a driving end which includes an end face and three ribs which are angularly arranged in intervals, each of the three ribs being formed as a part of a rectangle on the end face and including two right angles on the end face, every adjacent two of the three ribs defining a groove therebetween;

wherein all of apexes of the right angles of the three ribs are six apexes of a hexagon, and each of the three ribs further includes a side entirely overlapping with a side of the hexagon from one said apex to another said apex;

wherein an extension of a side of each said right angle extends through the apex of another said right angle.

2. The driving tool of claim 1, wherein every adjacent two of the three ribs are connected with a plane therebetween, and each said plane is parallel to a radially-facing face of one of the three ribs.

3. The driving tool of claim 1, wherein each of the three ribs further includes a side face whose height is a depth of the groove multiplied by [1/sin(30°)].

4. The driving tool of claim 1, wherein the end face has a center, and a first distance from a bottom of each said groove to the center is 0.20 mm to 1.50 mm smaller than a second distance from a radially-facing face of each of the three ribs to the center.

5. The driving tool of claim 1, wherein the driving tool is a rod member and has a fixed cross-section.

6. The driving tool of claim 5, wherein the rod member is L-shaped.

7. The driving tool of claim 1, further including a socket configured to be sleeved with a second driving tool.

8. The driving tool of claim 4, wherein the three ribs are equiangularly arranged in intervals; every adjacent two of the three ribs are connected with a plane therebetween, the plane has a width equal to or greater than ½ of a width of the radially-facing face; each said groove expands radially outward; each said radially-facing face has the same width; each of the three ribs further includes a side face whose height is equal to a depth of the groove multiplied by) [1/sin(30°)]; the height of the side face is between ⅕ to ⅓ of the second distance; the driving tool is a rod member which is L-shaped and has a fixed cross-section.

9. The driving tool of claim 1, wherein each said groove has a depth of 0.20 mm to 1.50 mm.

* * * * *